US011317674B2

(12) United States Patent
Jaschke et al.

(10) Patent No.: US 11,317,674 B2
(45) Date of Patent: May 3, 2022

(54) HELMET

(71) Applicant: UVEX ARBEITSSCHUTZ GMBH, Fürth (DE)

(72) Inventors: Simon Jaschke, Fürth (DE); Michael Abel, Feucht (DE); Frederic Schuss, Nuremberg (DE)

(73) Assignee: UVEX ARBEITSSCHUTZ GMBH, Fürth (DE)

( * ) Notice: Subject to any disclaimer, the term of this patent is extended or adjusted under 35 U.S.C. 154(b) by 48 days.

(21) Appl. No.: 16/637,007

(22) PCT Filed: Jul. 17, 2018

(86) PCT No.: PCT/EP2018/069337
§ 371 (c)(1),
(2) Date: Feb. 6, 2020

(87) PCT Pub. No.: WO2019/029952
PCT Pub. Date: Feb. 14, 2019

(65) Prior Publication Data

US 2020/0163402 A1 May 28, 2020

(30) Foreign Application Priority Data

Aug. 7, 2017 (DE) ..... 10 2017 213 645.6

(51) Int. Cl.
*A42B 3/28* (2006.01)
*A63B 71/10* (2006.01)

(52) U.S. Cl.
CPC ..... *A42B 3/283* (2013.01); *A63B 71/10* (2013.01)

(58) Field of Classification Search
CPC .. A42B 3/28; A42B 3/32; A42B 3/324; A42B 3/286; A42B 3/283
(Continued)

(56) References Cited

U.S. PATENT DOCUMENTS 3,813,696 A * 6/1974 Yeager ..... A42B 3/286 2/171.3
4,028,739 A * 6/1977 Bell ..... A42B 3/228 2/6.3
(Continued)

FOREIGN PATENT DOCUMENTS

CA 1154552 A 10/1983
DE 8426051 U1 1/1985
(Continued)

*Primary Examiner* — Katherine M Moran
(74) *Attorney, Agent, or Firm* — Browdy and Neimark, PLLC

(57) ABSTRACT

A helmet is provided including a helmet shell for spatially defining a head receiving space and an adjustable ventilation arrangement which is in flow-connection with the head receiving space. The ventilation arrangement includes at least one first ventilation device having at least one first ventilation channel running in the helmet shell and a first slider device, which is assigned to the at least one first ventilation channel and which for varying a flow cross section of the at least one first ventilation channel is displaceable between a ventilation channel opening position and a ventilation channel closing position along the helmet shell. The at least one first ventilation device moreover includes a first latching device for latching the first slider device to secure it in at least one predefined latched position.

16 Claims, 7 Drawing Sheets

(58) Field of Classification Search
USPC ..... 2/422
See application file for complete search history.

(56) References Cited

U.S. PATENT DOCUMENTS 4,081,865 A * 4/1978 Bergee ..... A42B 3/24 2/412
4,095,289 A * 6/1978 Kissen ..... A42B 3/288 128/201.24
4,095,593 A * 6/1978 Webbon ..... B64G 6/00 128/202.11
4,115,874 A * 9/1978 Hasegawa ..... A42B 3/281 2/171.3
4,309,774 A * 1/1982 Guzowski ..... A61F 9/068 2/8.6
4,502,480 A * 3/1985 Yamamoto ..... A62B 18/045 128/201.15
4,538,303 A * 9/1985 Schnitzler ..... A42B 3/24 2/424
4,549,542 A * 10/1985 Chien ..... A62B 18/045 128/201.24
4,555,816 A * 12/1985 Broersma ..... A42B 3/12 2/171.3
4,704,746 A * 11/1987 Nava ..... A42B 3/24 2/424
5,086,520 A * 2/1992 Arai ..... A42B 3/283 2/424
5,170,511 A * 12/1992 Kamata ..... A42B 3/283 2/424
5,231,703 A * 8/1993 Garneau ..... A42B 3/066 2/414
5,337,421 A * 8/1994 Jeng ..... A42B 3/066 2/171.3
5,345,614 A * 9/1994 Tanaka ..... A42B 3/281 2/425
5,388,278 A * 2/1995 Taniuchi ..... A42B 3/283 2/422
5,394,566 A * 3/1995 Hong ..... A42B 3/24 2/171.3
5,467,485 A * 11/1995 Casartelli ..... A42B 3/08 2/421
5,734,994 A * 4/1998 Rogers ..... A42B 3/128 2/411
5,915,537 A * 6/1999 Dallas ..... A42B 3/10 2/410
6,061,834 A * 5/2000 Liao ..... A42B 3/283 2/171.3
6,081,929 A * 7/2000 Rothrock ..... A42B 3/286 2/171.3
6,105,172 A * 8/2000 Shida ..... A42B 3/283 2/171.3
6,247,186 B1 * 6/2001 Huang ..... A42B 3/06 2/171.3
6,263,513 B1 * 7/2001 Murakami ..... A42B 3/0493 2/171.3
6,263,515 B1 * 7/2001 Turner ..... A42B 3/00 2/410
6,763,526 B1 * 7/2004 Hong ..... A42B 3/283 2/171.3
7,413,506 B2 * 8/2008 Arai ..... A42B 3/283 2/171.3
7,574,754 B2 * 8/2009 Arai ..... A42B 3/0493 2/410
7,865,976 B2 * 1/2011 Beddoe ..... A42B 3/125 2/425
7,975,320 B2 * 7/2011 Muskovitz ..... A42B 3/283 2/425
8,256,032 B2 * 9/2012 Muskovitz ..... A42B 3/283 2/410
9,675,129 B2 * 6/2017 Leedom ..... A42B 3/283
10,524,529 B2 * 1/2020 Muskovitz ..... A42B 3/12
10,786,028 B2 * 9/2020 Cech ..... A42B 3/04
2004/0064873 A1 * 4/2004 Muskovitz ..... A42B 3/283 2/410
2004/0250339 A1 * 12/2004 Musal ..... A42B 3/283 2/410
2007/0130672 A1 * 6/2007 Beddoe ..... A42C 2/002 2/410
2011/0083255 A1 * 4/2011 Krauter ..... A42B 3/283 2/410
2012/0180199 A1 7/2012 Chilson et al.
2013/0174330 A1 * 7/2013 Gafforio ..... A42B 3/283 2/412
2013/0191975 A1 * 8/2013 Wirthenstatter ..... A42B 3/006 2/423
2015/0282550 A1 * 10/2015 Musal ..... A42B 3/324 2/414
2015/0359680 A1 * 12/2015 Gardner ..... A42B 3/286 2/8.6
2016/0150845 A1 * 6/2016 Leedom ..... A42B 3/283 2/414
2016/0242487 A1 * 8/2016 LaRocque ..... A42B 3/069
2017/0188649 A1 * 7/2017 Allen ..... A63B 71/10
2018/0325205 A1 * 11/2018 Gardner ..... A42B 3/283
2019/0104800 A1 * 4/2019 Schuster ..... A42B 3/225
2019/0343215 A1 * 11/2019 Musal ..... A42B 3/281
2020/0229528 A1 * 7/2020 Szela ..... A42B 3/283
2021/0015196 A1 * 1/2021 Letendre ..... A42B 3/205

FOREIGN PATENT DOCUMENTS

DE 69714398 T2 2/2003
DE 69812594 T2 3/2004
DE 202011002353 U1 3/2011
EP 0427117 A1 5/1991
EP 0852917 A1 7/1998
EP 0966894 A1 12/1999
EP 2308333 A2 4/2011
JP 2000129529 A 5/2000
JP 2014221952 A 11/2014
KR 100299319 B1 * 9/2001
RU 2112411 C1 6/1998
SU 1281156 A3 12/1986

* cited by examiner

HELMET

CROSS-REFERENCE TO RELATED APPLICATIONS

This application claims the priority of German Patent Application Serial No. DE 10 2017 213 645.6, filed on Aug. 7, 2017, pursuant to 35 U.S.C. 119(a)-(d), the content of which is incorporated herein by reference in its entirety as if fully set forth herein.

FIELD OF THE INVENTION

The invention relates to a helmet, in particular a protective safety helmet, which is used, for example, for industrial safety or sports purposes.

BACKGROUND OF THE INVENTION

Through prior public use the prior art discloses a wide variety of helmets which comprise ventilation arrangements for controlling the climate of a head receiving space. These helmets are often not particularly user-friendly.

US 2012/0180199 A1 discloses a helmet having a ventilation closure arrangement. A latching arrangement of a ventilation closure element is possible. Details of the latching arrangement are not disclosed.

US 2016/0150845 A1 discloses a helmet having a ventilation control, which is assigned to a ventilation aperture. The ventilation control comprises a slide plate, the position of which can be frictionally secured.

A helmet disclosed by DE 697 14 398 T2 has adjustable apertures or valve apertures, in order to control an air circulation through the helmet. An air flow can be adjusted by moving slide elements. The slide elements are guided and their position can be frictionally secured.

DE 698 12 594 T2 discloses a crash-helmet having devices locking and releasing movable parts, such as slide pieces or casings for opening and closing air inlets. The device comprises a first element and a second element, which is connected to a helmet body. The first element comprises a pair of toothed bars, between which a block of the second element comprising toothed spring arms is arranged. The teeth mesh in the toothed bars and thus hold the movable part in a desired position. This notched arrangement is of intricate construction.

SUMMARY OF THE INVENTION

The object of the invention is to provide a helmet which on the one hand is particularly user-friendly and on the other affords good climate control to suit the individual.

According to the invention this object is achieved by a helmet, in particular a protective safety helmet, comprising a helmet shell for spatially defining a head receiving space, and an adjustable ventilation arrangement which is in flow-connection with the head receiving space and which comprises at least one first ventilation device having at least one first ventilation channel extending in the helmet shell, having a first slider device which is assigned to the at least one first ventilation channel and which for at least zonally varying a flow cross section of the at least one first ventilation channel is displaceable between a ventilation channel opening position and a ventilation channel closing position along the helmet shell, and having a first latching device for latching the first slider device to secure it in at least one predefined latched position in relation to the helmet shell, wherein the first latching device comprises at least one latch being in connection with the first slider device, and at least one counter-latch being in connection with the helmet shell for latching interaction with the at least one latch, wherein the at least one counter-latch is arranged facing the head receiving space, wherein the at least one latch is arranged facing away from the head receiving space on the first slider device.

The core of the invention resides in a first latching device, which allows latching of the first slider device to secure its position in relation to the helmet shell. The first slider device is releasably secured in the respective latched position. A latched connection then prevailing maintains an individually adjusted position of the first slider device. In order to shift the first slider device out of a latched position it is necessary to apply a (sliding) force, in particular manually, to the first slider device sufficient to over come the latched connection.

The ventilation arrangement is capable of controlling the climate in the head receiving space. The at least one first ventilation channel advantageously opens out into the head receiving space. It is advantageous if the at least one first ventilation channel also opens outside the helmet shell into the surroundings. The at least one first ventilation channel preferably extends over a full thickness of the helmet shell, affording a (flow) connection between the head receiving space and the surroundings when the first slider device is situated in the ventilation channel opening position.

It is advantageous if the first slider device in the ventilation channel closing position fully closes the at least one first ventilation channel, so that an exchange of air between the surroundings and the head receiving space is prevented. In the ventilation channel opening position the at least one first ventilation channel is at least partially, preferably fully, opened for the exchange of air between the surroundings and the head receiving space.

The first slider device is advantageously displaceably guided along or alongside the helmet shell. The first slider device, both in its ventilation channel opening position and in its ventilation channel closing position, is suitably accommodated at least partially in the helmet shell. In its displacement, a distance separating the first slider device from the head receiving space in a thickness direction of the helmet shell advantageously remains constant.

The first slider device is of single-piece or multipiece design, for example. A multipiece, in particular two-piece design is preferred for assembly reasons.

The first slider device suitably comprises at least one operating part for displacing the former. The at least one operating part is suitably externally accessible.

The at least one first ventilation device is advantageously arranged in a central area of the helmet shell. Alternatively, this is arranged in side faces of the helmet shell, for example.

The at least one latch is designed as a latching projection, for example, and is arranged on the first slider device. The at least one counter-latch is preferably of complementary design to the at least one latch and is arranged on the helmet shell, in particular on the inside. In the latched position at least one latch and at least one counter-latch come into releasable, interlocking engagement with one another.

The at least one counter-latch is advantageously formed on the inside of the helmet shell.

The flow cross section of the at least one first ventilation channel is advantageously arbitrary. The at least one first ventilation channel runs, at least zonally, on a straight line and/or curved path, for example.

The helmet shell is preferably rigid or inherently inflexible. It is advantageous if the helmet shell is supple on the inside. When the helmet is worn correctly, the head of a helmet wearer engages in the head receiving space or helmet interior.

A (strap) retaining system is suitably arranged on the helmet shell for securely holding the helmet shell on the head of the helmet wearer.

The helmet is advantageously symmetrical about a center plane.

The expressions used—"front", "back" and the like—preferably relate to a correct wearing of the helmet.

Further advantageous embodiments of the inventions are specified in the dependent claims.

The embodiment according to which the helmet comprises a multiplicity of latched positions for latching the first slider device to secure it in various latched positions, is particularly user-friendly. Between three and ten latched positions are suitably provided. Intermediate latched positions can suitably be assumed between a fully open ventilation channel opening position and a fully closed ventilation channel closing position. The interval between adjacent latched positions is preferably equidistant.

The counter-latches, which are arranged adjacently spaced from one another, in particular upon predefining the latched positions, preferably extend parallel to one another. They are preferably arranged in a latch strip area of the helmet shell. Between three and ten counter-latches are preferably provided.

The embodiment, wherein the first slider device is displaceable between a front latched position and a rear latched position in relation to the helmet provides that a distance between the first slider device and a front or rear end of the helmet varies as a function of the particular latched position of the first slider device. The first slider device is displaceable forwards and/or rearwards in order to influence the flow cross section of the at least one first ventilation channel. For example, in the fully closed ventilation channel closing position the first slider device is situated in a forward position in relation to the helmet, whereas in a fully open ventilation channel opening position the first slider device is situated in a rear position in relation to the helmet. An inverse arrangement is alternatively possible.

The at least one first guide recess configured such that it is formed in the helmet shell for guiding the first slider device between the ventilation channel opening position and the ventilation channel closing position and further configured such that it extends along the helmet shell, is preferably slot-like. The at least one first guide recess suitably passes right through the helmet shell in its thickness direction.

The embodiment configured such that the first slider device includes at least one coupling element which is arranged in the at least one first guide recess, and which is substantially shorter in a longitudinal direction of the helmet than at least the one first guide recess, preferably ensures a functionally reliable, guided displacement of the at least one coupling elements and consequently the first slider device in relation to the at least one first guide recess and the helmet shell. The at least one coupling element preferably passes through the at least one first guide recess. Alternatively, the latter engages only partially in the at least one first guide recess. The first slider device is suitably displaceable between 5 mm and 25 mm, preferably between 8 mm and 18 mm.

The at least one block element for at least zonally varying the flow cross section of the at least one first ventilation channel, is preferably plate or web-like. It is advantageously of a shape and size that corresponds to an adjacent cross section of the at least one first ventilation channel. The at least one block element is advantageously capable, in the fully closed ventilation channel closing position of the first slider device, of fully closing off at least some zones of the at least one first ventilation channel, so as to prevent an exchange of air.

The embodiment configured such that at least two block elements are arranged spaced from one another for at least zonally varying the flow cross sections of the at least two first ventilation channels, is particularly user-friendly and leads to an especially efficient climate control of the head receiving space. By shifting just one first slider device it is possible to influence the flow cross section of at least two ventilation channels.

An embodiment, wherein the helmet is configured such that the at least one first ventilation device is designed as an air admission device for feeding fresh air to the head receiving space, or a venting device for leading air out of the head receiving space provides that the helmet lends itself particularly well to climate control.

An another embodiment, wherein the helmet is configured such that the ventilation arrangement includes at least one further ventilation device, which is arranged spaced from the at least one first ventilation device and which acts in functional opposition to at least the one first ventilation device provides that the helmet lends itself particularly well to climate control.

A preferred embodiment of the invention is described below by way of example, referring to the drawing attached.

DESCRIPTION OF THE PREFERRED EMBODIMENT

Figure 1:
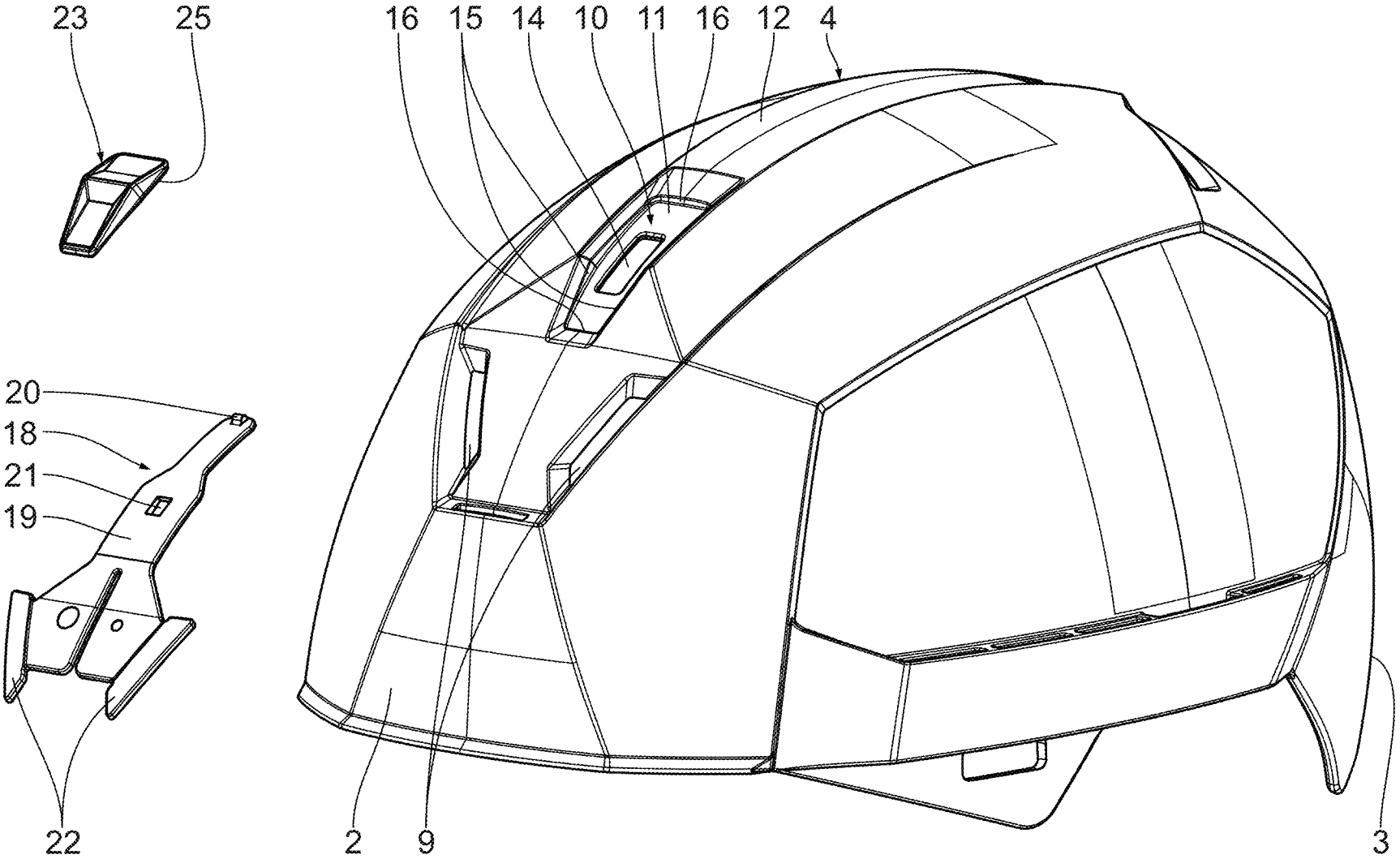
FIG. 1 shows a perspective, exploded view of a helmet according to the invention.
Figure 2:
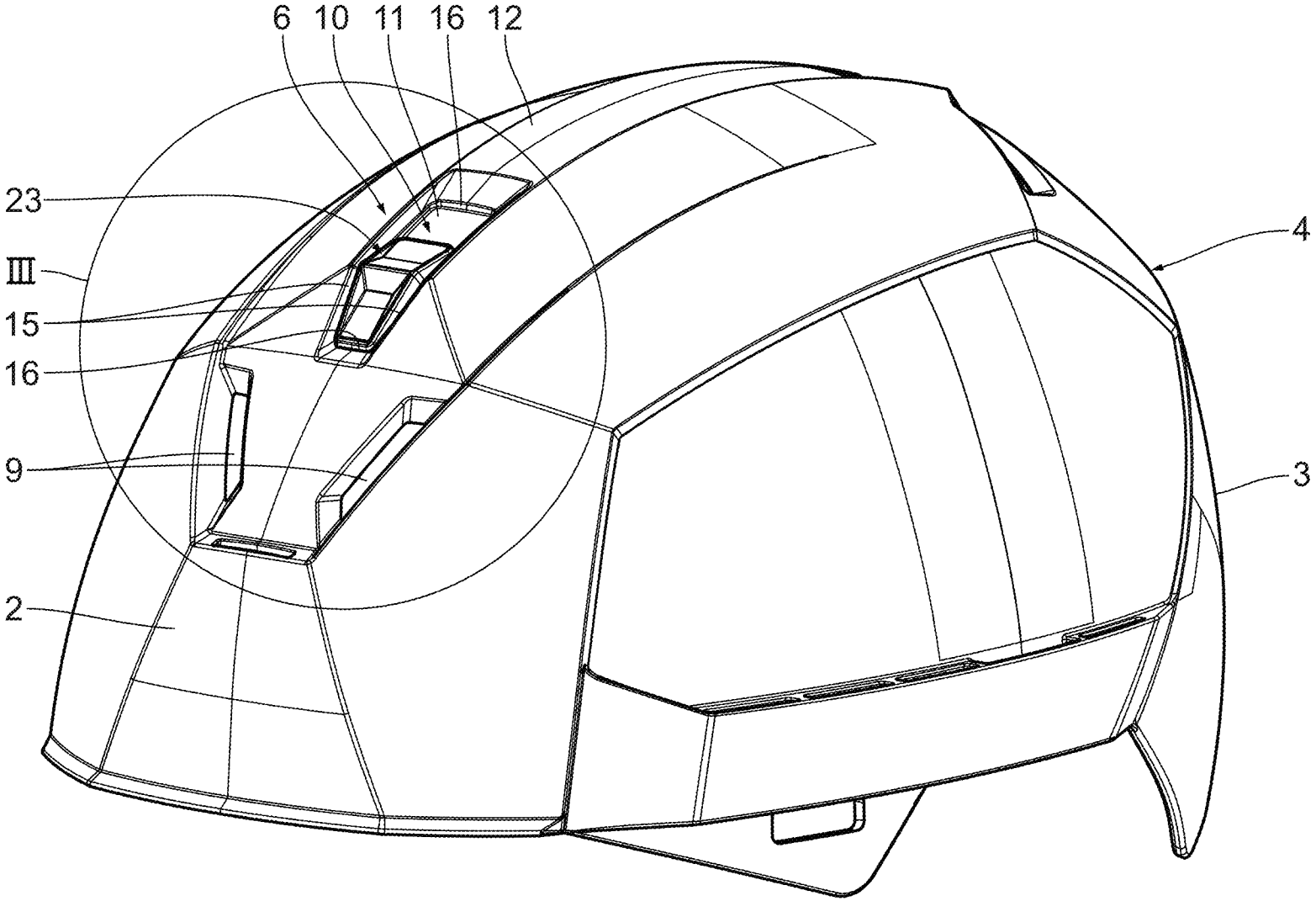
FIG. 2 shows a perspective view of the helmet shown in FIG. 1 in the assembled state.
Figure 3:
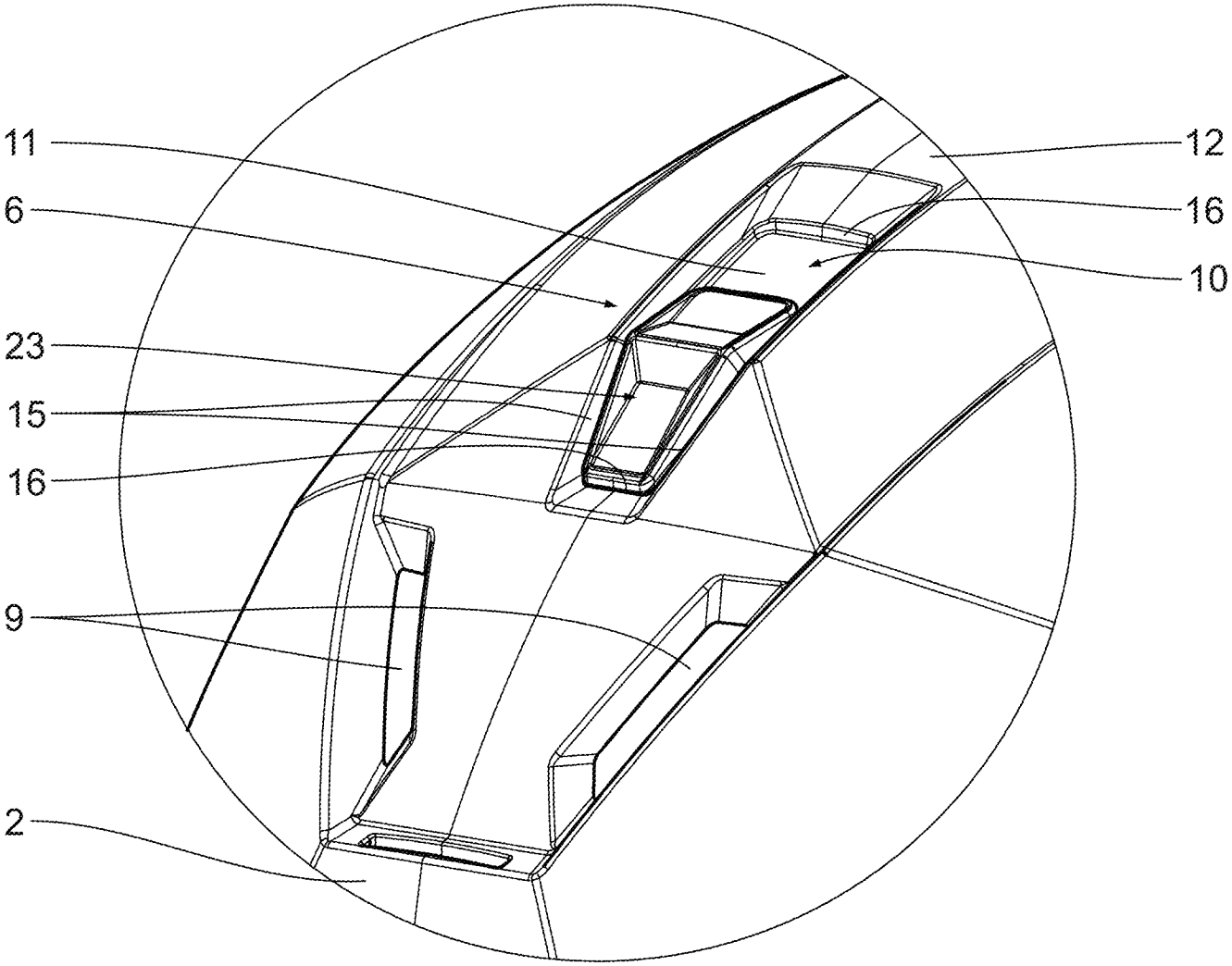
FIG. 3 shows the detail III identified in FIG. 2, which shows a first ventilation device of the helmet illustrated in FIGS. 1 and 2.
Figure 4:
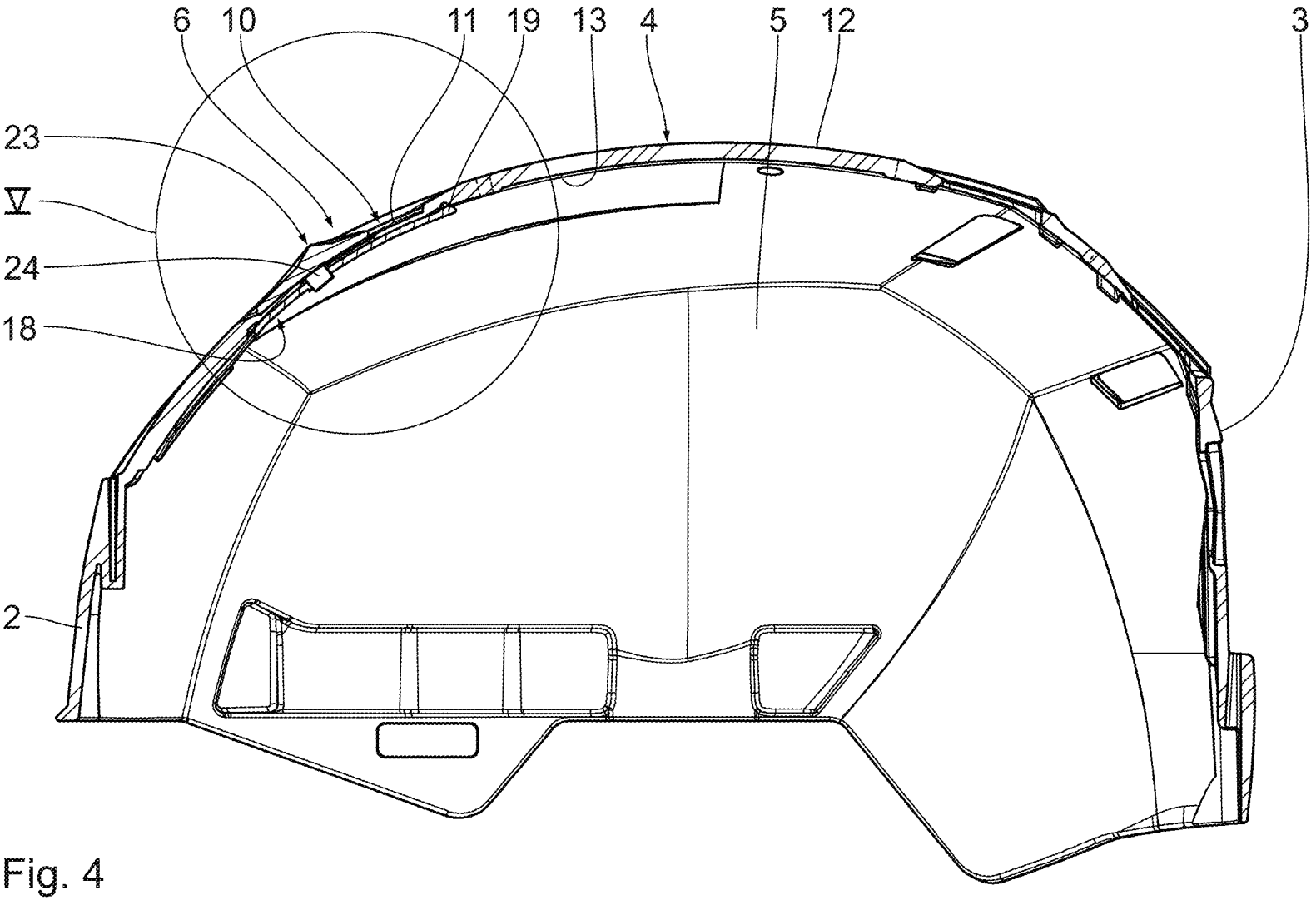
FIG. 4 shows a longitudinal section through the helmet shown in FIGS. 1 and 2.
Figure 5:
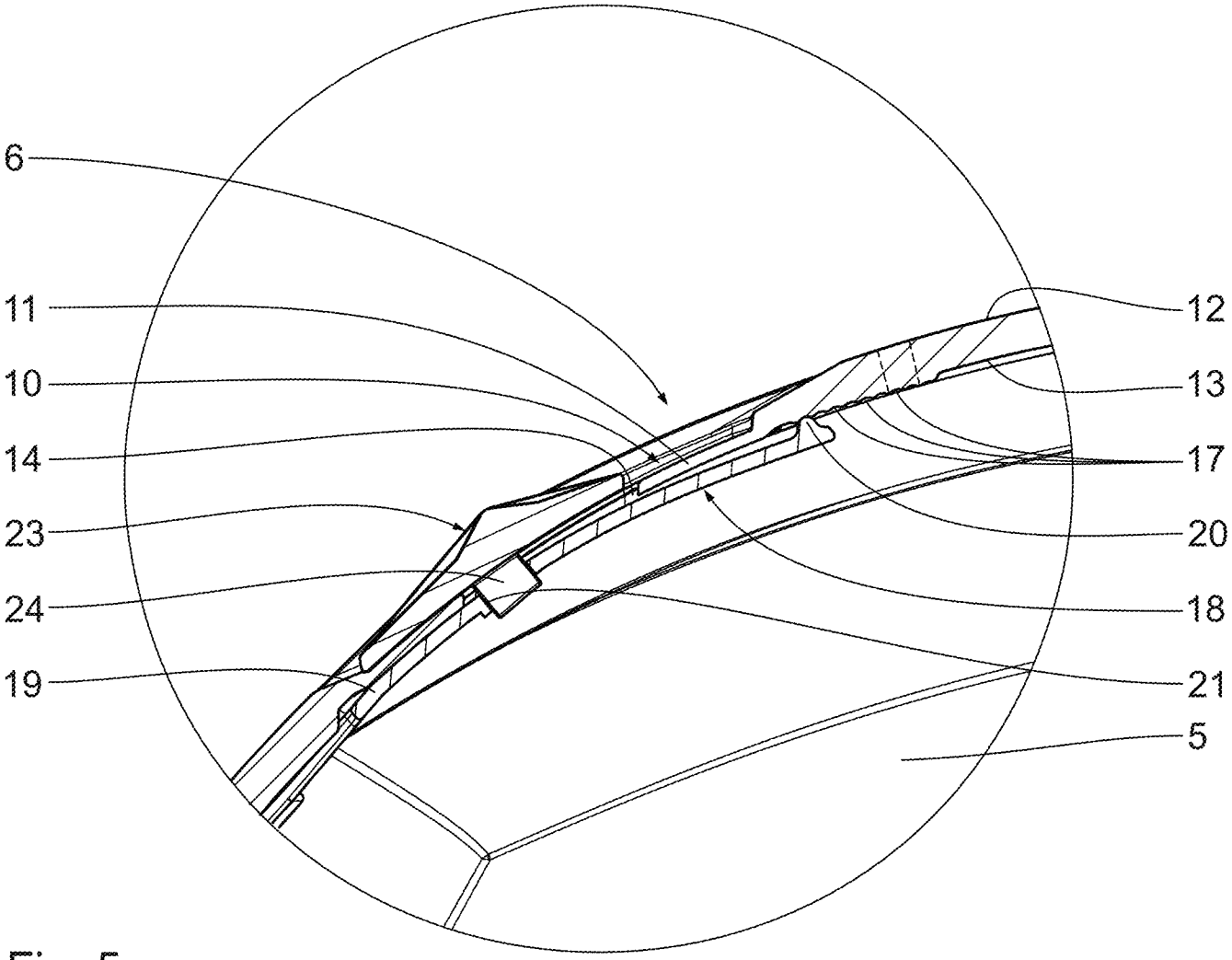
FIG. 5 shows the detail V identified in FIG. 4.
Figure 6:
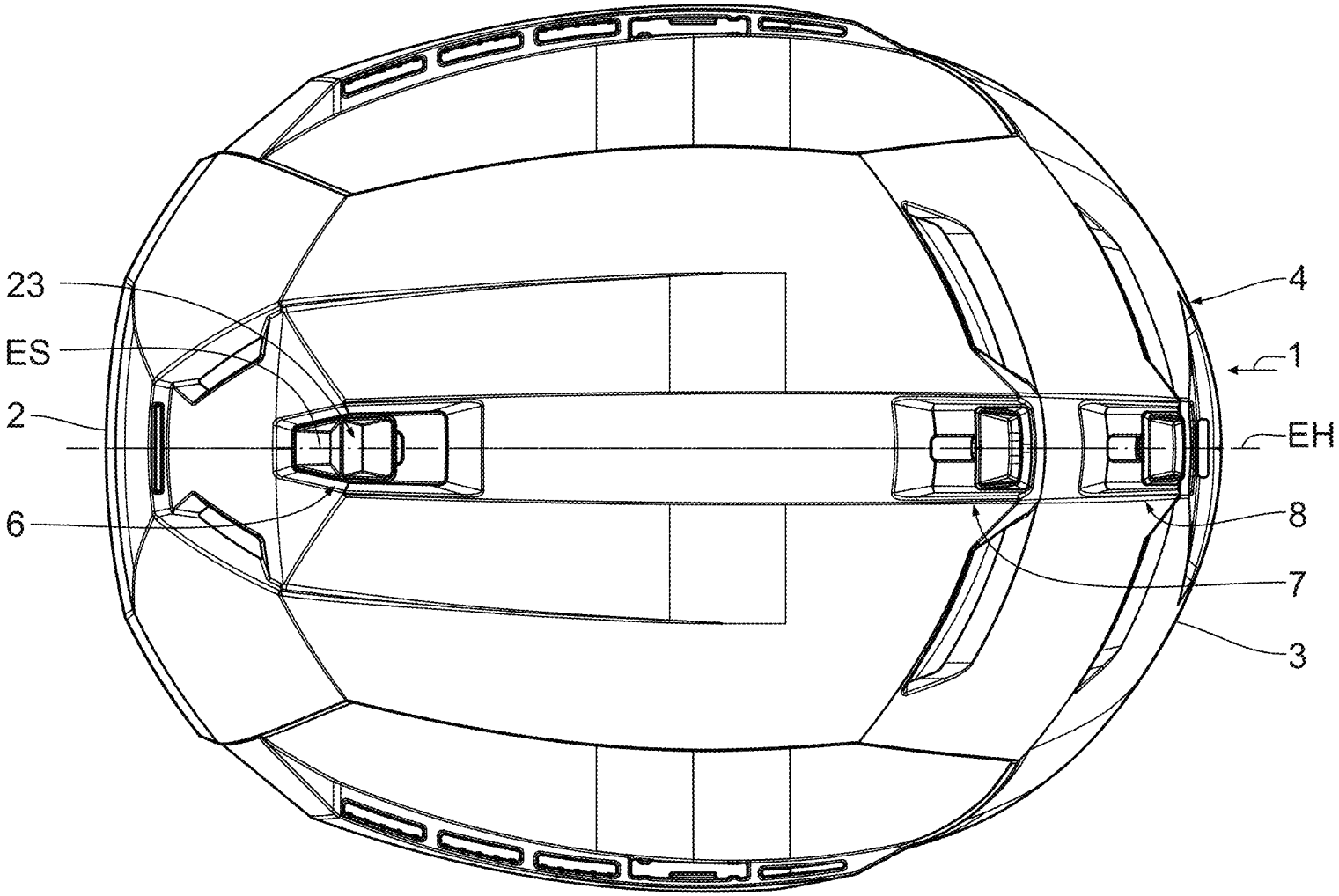
FIG. 6 shows a top view of the assembled helmet shown in FIG. 2.
Figure 7:
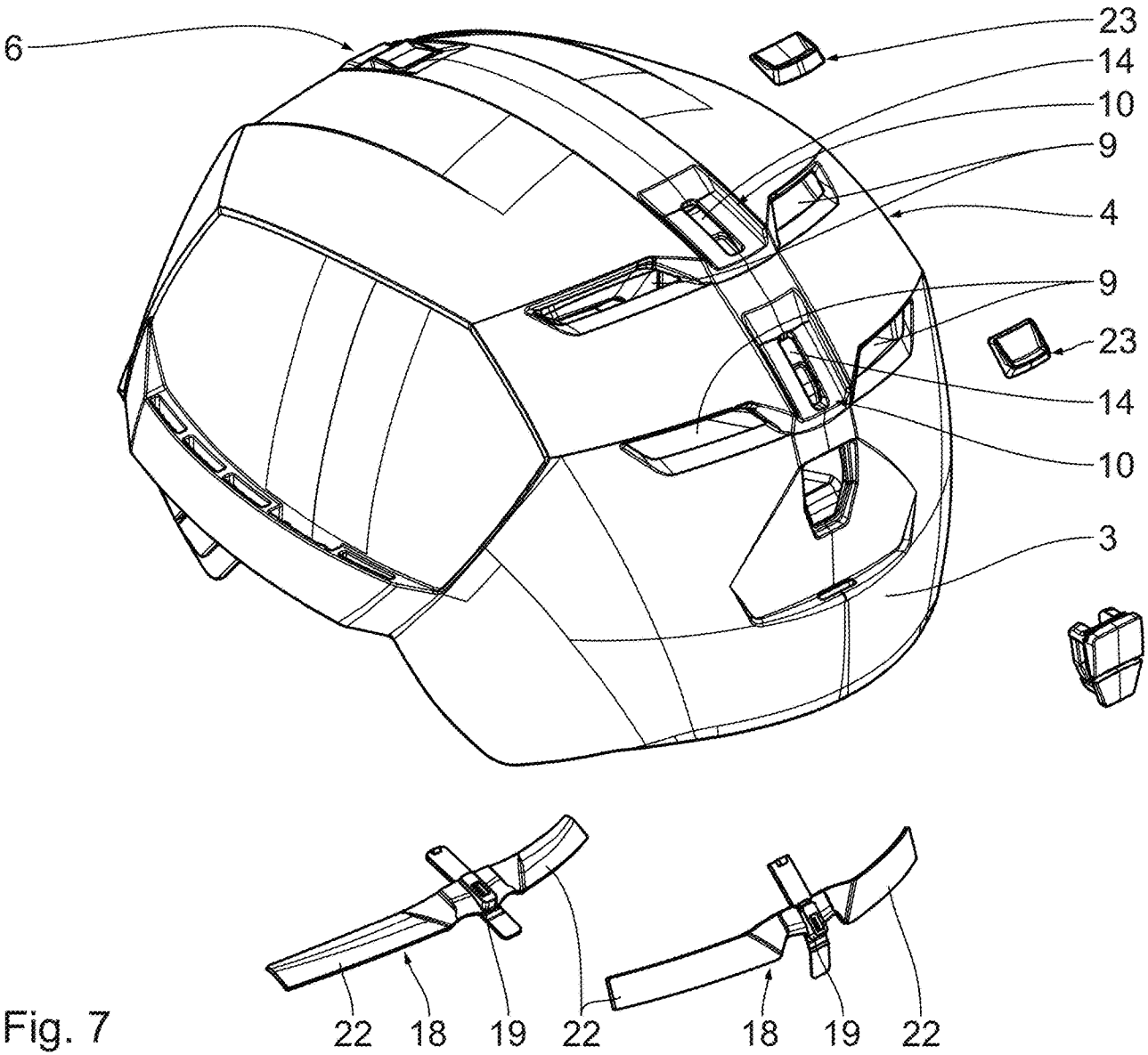
FIG. 7 shows a further perspective, exploded view of the helmet shown in FIG. 1, which in particular illustrates a rear part of the helmet.

A helmet represented in the figures is designed as an industrial safety helmet. The helmet is symmetrical about a center plane EH, which extends in a longitudinal direction 1 of the helmet between its front end 2 and its rear end 3.

The helmet comprises a stable helmet shell 4, which externally spatially defines a head receiving space 5 designed to accommodate the head of a helmet wearer (not shown).

The climate of the helmet shell 4 or the head receiving space 5 can be controlled. For this purpose, the helmet comprises a ventilation arrangement having three independent ventilation devices 6, 7, 8 arranged spaced from one another. The first ventilation device 6 is arranged adjacent to the front end 2 of the helmet shell 4 and is designed as an air admission device. The second ventilation device 7 and the third ventilation device 8 are arranged adjacent to one another and adjacent to the rear end 3 in the helmet shell 4. They are designed as venting devices.

The ventilation devices 6, 7, 8 are basically of identical design construction, but differ in their shape and/or dimensions.

The first ventilation device 6 comprises two elongated first ventilation channels 9, which are arranged spaced from the center plane EH of the helmet and converge in the direction of the front end 2. The first ventilation channels 9 pass right through the thickness of the helmet shell 4. They form air admission channels.

Adjacent to the first ventilation channels 9, the first ventilation device 6 comprises a first elongated guide depression 10, which is formed in the helmet shell 4 and is outwardly open. The first guide depression 10 is inwardly defined by a first guide plate 11 of the helmet shell 4. The first guide plate 11 is recessed in relation to an outer surface 12 of the helmet shell 4 and flush with an adjacent inner surface 13 of the helmet shell 4. The center plane EH of the helmet passes centrally through the first guide depression 10.

An elongated first guide aperture 14, which passes right through the first guide plate 11 in a thickness direction of the helmet shell 4 and opens out towards the head receiving space 5, is formed in the first guide depression 10. The first guide aperture 14 is arranged in a central area of the first guide plate 11. It is arranged spaced from longitudinal edges 15 and longitudinal ends 16 of the first guide depression 10. The first guide aperture 14 has a length in the longitudinal direction 1 of the helmet which is substantially greater than its width perpendicular to the longitudinal direction 1.

Adjacent to the first guide aperture 14 the first ventilation device 6 comprises a multiplicity of separate counter-latches 17, which are formed on the inside of the helmet shell 4 and arranged adjacent to one another. The counter-latches 17 are arranged adjacent to the longitudinal edge 15 of the first guide depression 10 facing the rear end 3 of the helmet. The counter-latches 17 are at different distances from the front end 2 of the helmet and are designed as latching depressions, which in cross section are of triangular or circular segmental shape, for example. They face and are open towards the head receiving space 5. The counter-latches are advantageously spatially defined by latching teeth.

The first ventilation device 6 moreover comprises a first slider device 18, which is symmetrical about a center plane ES and comprises an integral first carrier 19. A latching projection (or latch) 20 protrudes outwards from the end of the first carrier 19. The first carrier 19 and the latching projection 20 are integrally connected to one another.

A first fitting aperture 21 is formed in the first carrier 19.

The first carrier 19 carries two first block plates 22, which run spaced from and obliquely to one another. The first block plates 22 are arranged at an end of the first carrier 19 opposite the latching projection 20. They face towards the front end 2 of the helmet. In its profile each first block plate 22 matches an aperture cross section of a first ventilation channel 9.

The first slider device 18 moreover comprises a first operating grip 23, which is coupled to the first carrier 19 by means of a coupling element 24. The coupling element 24 has a width perpendicular to the center plane EH of the helmet which corresponds to the width of the first guide aperture 14. The first guide aperture 14 is of a length in the longitudinal direction 1 of the helmet which is substantially greater than a length of the first coupling element 24 in the longitudinal direction 1 of the helmet. The coupling element 24 passes through the fitting aperture 21, so that the first operating grip 23 and the first carrier 19 are fixedly connected to one another.

In the assembled state of the helmet the first operating grip 23 is situated in the first guide depression 10. A bottom surface 25 of the first operating grip 23 here faces the first guide plate 11 and externally rests thereon. The coupling element 24 passes through the first guide aperture 14 and the first fitting aperture 21, so that on the inner side the first carrier 19 is held on the helmet shell 4 and the first operating grip 23 is held externally on the first carrier 19. The first block plates 22 are situated adjacent to the first ventilation channels 9, whilst the latching projection 20 is in latched connection with a counter-latch 17, forming a first latching device.

When the first slider device 18 is shifted or displaced through the application, by a helmet wearer, of a corresponding slide force to the first slider device 18 via the first operating grip 23, the bottom surface 25 of the first operating grip 23 slides externally along the first guide plate 11, whilst the first carrier 19 on the inside slides along the helmet shell 4 and shifts in relation to the helmet shell 4. In so doing the first block plates 22 are also shifted in relation to the first ventilation channels 9, which has an influence on their adjacent, open, effective flow cross section. A displacement is preferably possible over a displacement travel of 10 mm to 18 mm.

For shifting the first slider device 18, the latching projection 20 and the respective active counter-latch 17 must be disengaged. A corresponding latch resistance must be overcome. This allows a graduated adjustment. Five to nine latched positions are advantageously provided. The displacement of the first slider device 18 is limited by the first longitudinal edges 16 of the first guide plate 11.

Shifting the first slider device 18 towards the front end 2 of the helmet leads to a zonal reduction in the effective flow cross sections of the first ventilation channels 9. When the first slider device 18 assumes a minimum distance from the front end 2, the first ventilation channels 9 are fully closed by the first block plates 22. When the first slider device 18 is at a maximum distance from the front end 2 of the helmet, the first block plates 22 are preferably located spaced from the first ventilation channels 9, so there is no closure of the first ventilation channels 9. In intermediate positions the first ventilation channels 9 are partially closed.

The second ventilation device 7 and the third ventilation device 8 are of a corresponding design to the first ventilation device 6. For the sake of brevity, reference is made with regard to the construction and operating principle of the ventilation devices 7, 8 to the design of the first ventilation device 6. In the case of the second and third ventilation device 7 and 8 there are in each case preferably between three and seven latched positions. The sliding travel of the respective slider device is preferably between 7 mm and 16 mm.

In the opened state of the first slider devices 18 air is able to flow into the head receiving space 5 from the front via the ventilation channels 9. Cooler ambient air can thus be introduced into the helmet shell 4.

Air from the head receiving space 5 can leave the head receiving space 5 again at the rear via the ventilation devices 7, 8, when the latter are at least partially open. The air warmed by the head of the helmet wearer can be led back out of the helmet shell 4 via the ventilation device 7, 8.

The helmet can thus be easily adjusted, for example, to prevailing external climatic conditions. Furthermore, the helmet can also be individually adjusted to the heat balance of the body of the helmet wearer.

The invention claimed is:

1. A helmet, comprising a helmet shell for spatially defining a head receiving space, and an adjustable ventilation arrangement which is in flow-connection with the head receiving space, the adjustable ventilation arrangement comprising:

at least one first ventilation device comprising:

at least one first ventilation channel extending in the helmet shell, a first slider device assigned to the at least one first ventilation channel and displaceable between a ventilation channel opening position and a ventilation channel closing position along the helmet shell for at least zonally varying a flow cross section of the at least one first ventilation channel, at least one elongated first guide recess formed in the helmet shell for guiding the first slider device between the ventilation channel opening position and the ventilation channel closing position, and a first latching device for latching the first slider device to secure said first slider device in at least one predefined latched position in relation to the helmet shell, wherein the first latching device comprises at least one latch in connection with the first slider device, and at least one counter-latch in connection with the helmet shell for latching interaction with the at least one latch, wherein the at least one counter-latch is arranged facing the head receiving space, wherein the at least one latch is arranged facing away from the head receiving space on the first slider device, wherein the at least one latch and the at least one counter-latch must be disengaged from one another when the first slider device is shifted between the ventilation channel opening position and the ventilation channel closing position.

2. The helmet as claimed in claim 1, wherein said helmet is a protective safety helmet.

3. The helmet as claimed in claim 1, comprising a multiplicity of latched positions for latching the first slider device to secure the first slider device in various latched positions.

4. The helmet as claimed in claim 1, comprising a multiplicity of counter-latches arranged adjacently spaced from one another.

5. The helmet as claimed in claim 4, wherein the counter-latches are arranged adjacently spaced from one another to predefine the at least one predefined latched position.

6. The helmet as claimed in claim 1, wherein a first center plane of the first slider device coincides with a center plane of the helmet.

7. The helmet as claimed in claim 6, wherein the first slider device is displaceable in the center plane of the helmet.

8. The helmet as claimed in claim 1, wherein the first slider device is displaceable between a front latched position and a rear latched position in relation to the helmet.

9. The helmet as claimed in claim 1, wherein the at least one elongated first guide recess extends along the helmet shell.

10. The helmet as claimed in claim 1, wherein the first slider device comprises at least one coupling element arranged in the at least one elongated first guide recess, and which is shorter in a longitudinal direction of the helmet than the at least one elongated first guide recess.

11. The helmet as claimed in claim 1, wherein the first slider device comprises at least one block element for at least zonally varying the flow cross section of the at least one first ventilation channel.

12. The helmet as claimed in claim 11, comprising at least two block elements arranged spaced from one another for at least zonally varying the flow cross sections of the at least two first ventilation channels.

13. The helmet as claimed in claim 1, wherein the at least one first ventilation device comprises one of the group including an air admission device for feeding fresh air to the head receiving space, and a venting device for leading air out of the head receiving space.

14. The helmet as claimed in claim 1, wherein the adjustable ventilation arrangement further comprises at least one second ventilation device, which is arranged spaced from the at least one first ventilation device and which acts in functional opposition to at least the one first ventilation device.

15. The helmet as claimed in claim 1, wherein the at least one counter-latch is formed on an inside of the helmet shell.

16. The helmet as claimed in claim 1, wherein the at least one latch is a latching projection.

* * * * *